United States Patent [19]

Santucci

[11] 4,418,727

[45] Dec. 6, 1983

[54] WEFT INSERTION DEVICES ON LOOMS HAVING A MOTIONLESS WEFT RESERVE

[75] Inventor: Nicola Santucci, Schio, Italy

[73] Assignee: Nuovo Pignone S.p.A., Firenze, Italy

[21] Appl. No.: 279,321

[22] Filed: Jul. 1, 1981

Related U.S. Application Data

[63] Continuation-in-part of Ser. No. 259,978, May 4, 1981, which is a continuation of Ser. No. 145,039, Apr. 30, 1980, which is a continuation of Ser. No. 26,313, Apr. 2, 1979, which is a continuation of Ser. No. 901,790, May 1, 1978, which is a continuation of Ser. No. 725,345, Sep. 21, 1976.

[30] Foreign Application Priority Data

Oct. 3, 1979 [IT] Italy ..... 27952 A/75

[51] Int. Cl.[3] ..... D03D 47/18

[52] U.S. Cl. ..... 139/448

[58] Field of Search ..... 139/446, 447, 448

[56] References Cited

U.S. PATENT DOCUMENTS 2,192,728 3/1940 Dewas ..... 139/448

3,580,291 5/1971 Piccoli ..... 139/448

4,129,155 12/1978 Merisio ..... 139/448

FOREIGN PATENT DOCUMENTS 716906 10/1966 Italy ..... 139/448

49-6146 2/1974 Japan ..... 139/448

*Primary Examiner*—Henry Jaudon

*Attorney, Agent, or Firm*—Hedman, Casella, Gibson, Costigan & Hoare

[57] ABSTRACT

A weft transfer device having special configuration of leading and drawing pincers for inserting the weft in a shuttleless loom. The device includes a leading pincer having a boxlike body shaped to offer the entrance at high speed of the wefts and smooth sliding of the warp threads and a rigid and semi-rigid grasping surfaces, the semi-rigid surface being pressed toward the rigid surface by two independent leaf springs engaging the lateral edge of the semi-rigid surface blade. The drawing pincer includes a lower fixed grasping member and an upper hook-shaped member pivoted to the lower member and forced into engagement therewith by a leaf spring.

3 Claims, 17 Drawing Figures

WEFT INSERTION DEVICES ON LOOMS HAVING A MOTIONLESS WEFT RESERVE

This application is a continuation-in-part of application Ser. No. 259,978, filed May 4, 1981, which, in turn, is a continuation of Ser. No. 145,039, filed Apr. 30, 1980, in turn, a continuation of Ser. No. 26,313, filed Apr. 2, 1979, in turn, a continuation of Ser. No. 901,790, filed May 1, 1978, in turn, a continuation of Ser. No. 725,345, filed Sept. 21, 1976, and relates to weft transfer devices for shuttleless looms having a movable grasping device and with a stationary weft reserve and more particularly to such devices formed by two members, one located on the feed side and having the purpose of taking and feeding the weft end up to the half of the warp shed and called the leading pincer, and the other for taking the weft at the half of the warp shed and drawing it through the remaining half of the warp shed and called the drawing pincer.

In the conventional constructions, the leading pincer is composed of a boxlike body which has grasping component parts constituted by a stiff surface on which a weft-presser blade rests and is urged by a single-blade leaf spring which may be bifurcated. The drawing pincer is formed by two rigid branches, each equipped with a grasping surface, the branches being opposed to one another and being loaded by a spring to form a grasping aperture having planar and parallel surfaces.

Because of the high speed which is required to carry out hundreds of weft insertions each minute, the accelerations inherent therein, the elasticity of the strips or rods which actuate the pincers, the type of guides of said strips, and other reasons, intensive vibrations are caused to occur in the pincers, which vibrations tending to set apart, as a function of the masses, the grasping components from each other one, the result being the release and loss of the weft thread during feed, draw or transfer. The drawing pincer is particularly exposed to vibrations.

To avoid such vibration and thread release, the loading of the spring holding the grasping members together must be increased, substantially increasing the grasping pressure on the weft. To insert the thread in the aperture of the drawing pincer when the spring loading is increased, it becomes necessary to clamp the grasping members of the leading pincer and clamp brakes on the thread so as to obtain on the two ends of the weft thread the overall drag necessary for the insertion of the thread into the drawing pincer aperture. On the other hand, inasmuch as the grasping aperture, both on the leading pincer and the drawing pincer, is composed of parallel planes close to one another which begin with a short, wide-angled, V-shaped input, even though the value of the pressure may be low, the drag on the two ends of the thread necessary for the insertion is not negligible.

Where the weft thread is not very sturdy, the thread can be torn at the instant of time of the shift. If the force pressing the grasping surfaces of the drawing pincer together is reduced so as to insert the weft thread without breaking, the drawing pincer is no longer capable of drawing the weft to the outlet of the warp shed but, instead, loses the weft on its way.

The foregoing operative defect is aggravated if one has to weave, in succession, a plurality of different weight wefts because the weft having the heavier weight per meter requires a more intense braking and more intense drags for controlling the mass forces for the transfer. The clamping of the grasping members of the pincers must be adjusted on the basis of the heavier thread. The minimum resistance of the weft should be increased so as to prevent its breakage at the shift or the grasp by the leading pincer. Only groups of homogeneous wefts, of relatively the same resistance, can be weaved. Even with a single type of weft, the minimum necessary resistance of the weft is well over the usual ranges for looms having a spool-carrying shuttle. The minimum weft resistance rapidly increases as the number of insertions a minute is increased.

Where grasp and transfer of the threads take place under heavy clamping of the drawing pincer, heavy clamping of the leading pincer and heavy braking, the deposit of fibers and impurities under the grasping members and the brakes is considerable and requires frequency stoppage and cleaning of the weaving looms.

An object of the present invention is to provide weft transfer devices in which the grasping members of the leading and the drawing pincers are so proportioned and stressed so as to make possible the transfer of both light and heavy weft threads and combination of such threads, either alone or woven together with other wefts having any count.

A further object of the invention is to reduce the braking of the yarn and the clamping of the pincers' grasping members heretofore necessary to effect yarn transfer.

Still a further object of the invention is to limit the deposition of fibers and impurities under the pincers' grasping members and the braking members and the consequential stoppages and cleaning occasioned thereby.

The weft transfer device of the invention includes a leading pincer having a boxlike body shaped in its front portion so as to allow entrance of the weft thread at high speed and provide smooth sliding of the warp threads. A horizontal rigid grasping plane is formed on the side wall by milling. A semi-rigid blade rests on the grasping plane and is pressed on two lateral edges by two leaf springs independent of one another and independently loaded. The first spring acts on the internal edge of the semi-rigid blade at a point close to the front curve of such blade. The second spring acts on the outer edge and on the rear of the blade. The blade has a planar-wedge-like grasping area, and immediately behind such area, has a portion of substantially reduced thickness. At the rear end, the blade has a portion which is widened and of the original thickness where the blade is affixed to the pincer body by means of screws.

The drawing pincer has two grasping branches. The upper hook-shaped branch is movable and is linked about a pin which is forcibly inserted in the lower branch. The latter, in its turn, is affixed to the pincer-carrier. The movable branch is driven to rotation by a sturdy leaf spring into engagement with an abutment formed on the fixed branch. The portion of the fixed branch outward from the abutment is formed by a short resilient blade which has, at its end, a widened surface which is planar on its top to provide the lower grasping plane. The lower plane is inclined with respect to the horizontal and is weakly urged by the resilient blade upwards and against a corresponding grasping surface on the leaf spring biased hook-shaped branch. The hook is formed by a horizontal under surface and a cylindrical surface upper surface. The grasping aperture thus obtained is wedge-like.

The accompanying drawings show, by way of example, an embodiment of the couple of weft-insertion devices according to the invention.

Figure 9:
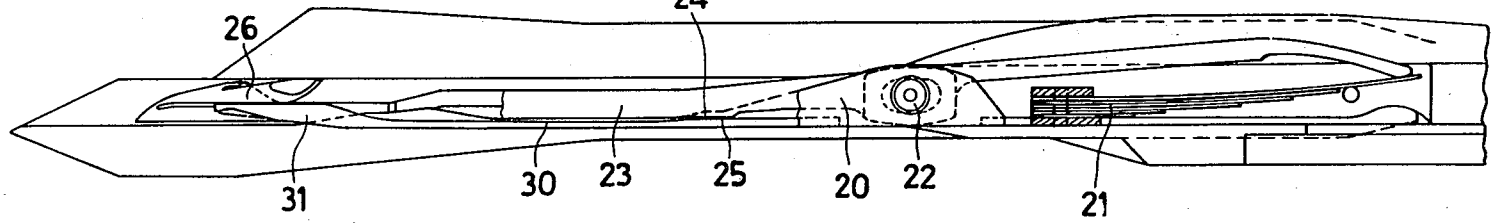
FIG. 9 is a front view, from the weaver's position, of the drawing pincer of the instant invention.
Figure 10:
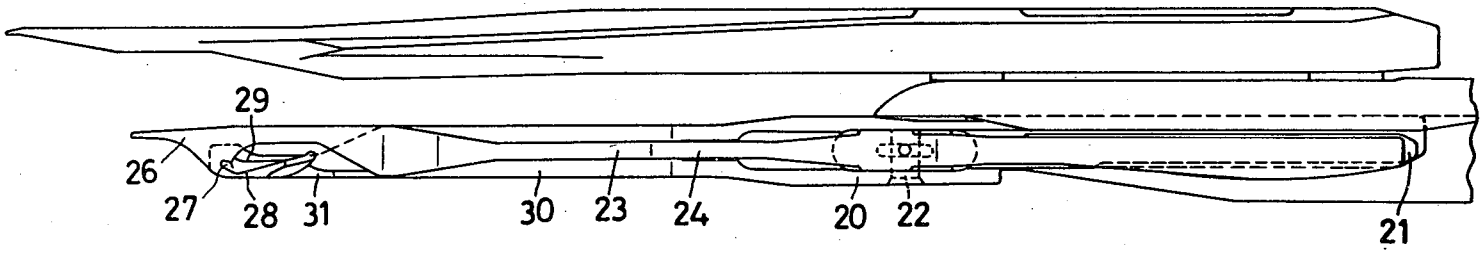
FIG. 10 is a top view of the drawing pincer of FIG. 9.
Figure 11:
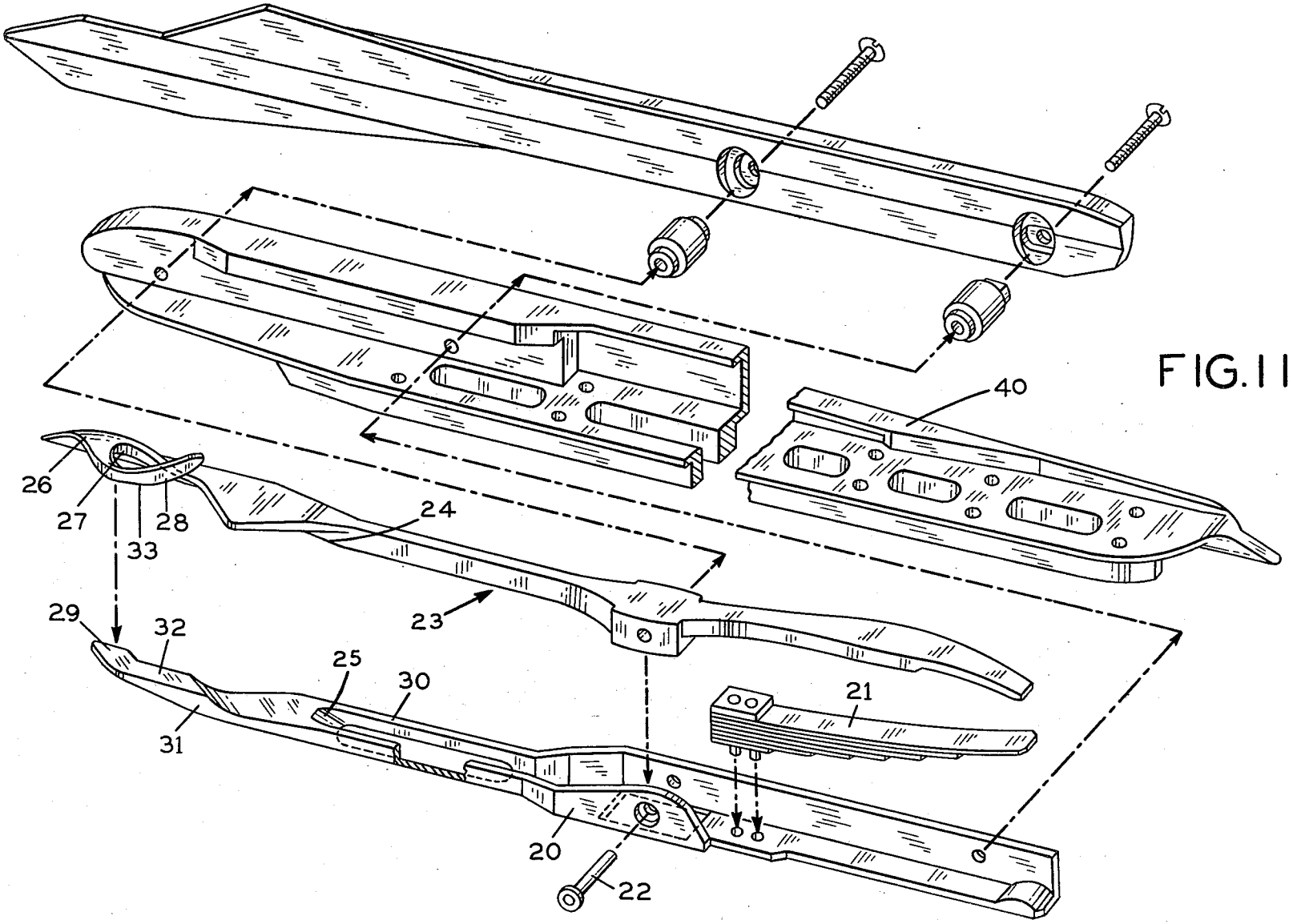
FIG. 11 is an exploded perspective view of the drawing pincer of FIG. 9.
Figure 12:
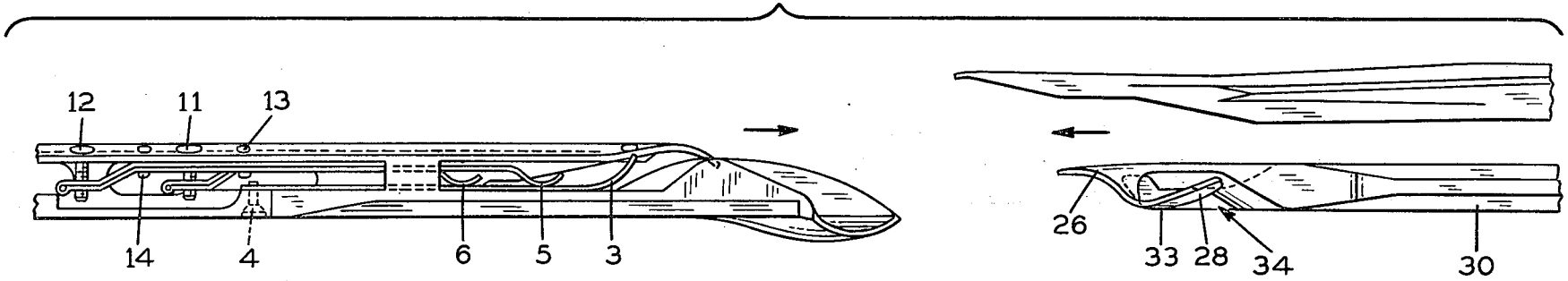
FIG. 12 is a top view showing the forward ends of the leading and drawing pincers as such pincers are approaching each other.

The leading pincer (FIGS. 1–4) includes a boxlike body, generally designated 1, into which the drawing pincer (FIGS. 9–11) penetrates at the weft shift. (FIGS. 12–17). The front portion of body 1 is shaped so as to provide the input, at high speed, of the weft which is arranged diagonally and has a thickness up to 4 millimeters and to provide smooth sliding of the warp thread both incoming and outcoming. On the sidewall of the box-like body 1, a rigid grasping plane 2 is formed. On plane 2 is mounted a small weft-clamping blade 3 affixed at its rear end to the pincer body by screws 4. Blade 3 is biased into engagement with grasping plane 2 by two elongated twin-blade leaf-springs 5 and 6 which engage and bias blade 3 into engagement with plane 2 along the marginal side edges of the blade.

Figure 7:
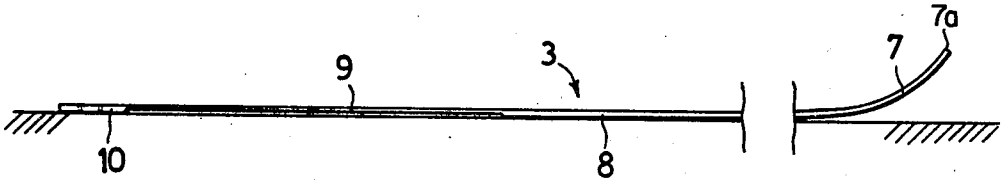
FIG. 7 is a top view of the semi-rigid blade of the leading pincer.
Figure 8:
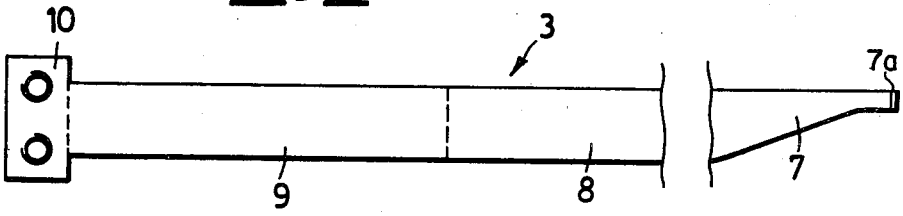
FIG. 8 is a side view of the semi-rigid blade of FIG. 7.

Weft-clamping blade 3, shown in enlarged scale in FIGS. 7 and 8, has a resiliency proportional to the load of springs 5, 6 and includes a front input portion 7 which is curved, a planar portion 8 which rests on rigid plane 2 of pincer body 1, a subsequent portion 9 having a considerably reduced thickness and high flexibility, and an end portion 10 with the same thickness as portion 8 to permit fastening of the blade to pincer body 1 by the screws 4. The tip *7a* of blade 3 projects into aperture *2a* in plane 2 of pincer body 1. The curvature of the front input portion 7 of blade 3 forms, with rigid plane 2 of pincer body 1, a wedge-like grasping aperture the angle of aperture of which is, starting from a value of 1 millimeter or more, less than the angle of friction between the thread and the metals of rigid grasping plane 2 and blade 3, irrespective of the nature of the thread and the metals. For example, the metals may be machined chromium. The wedge-like grasping aperture, with such features, takes and holds the weft thread, as soon as the thread is presented thereto and the aperture is driven toward the thread, no matter how high the load of spring 5, 6 on blade 3 may be, because the drag on the end of the weft thread to be cut could be nil and the drag on the braked end of such thread coming from the spool can be at any value between nil and the ultimate tensile strength of the thread.

Figure 1:
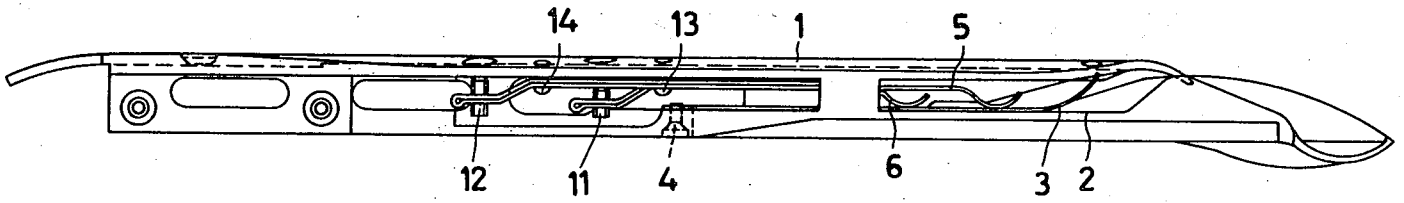
FIG. 1 shows a top view of the leading pincer with parts omitted so as to make the grasping members visible.
Figure 2:
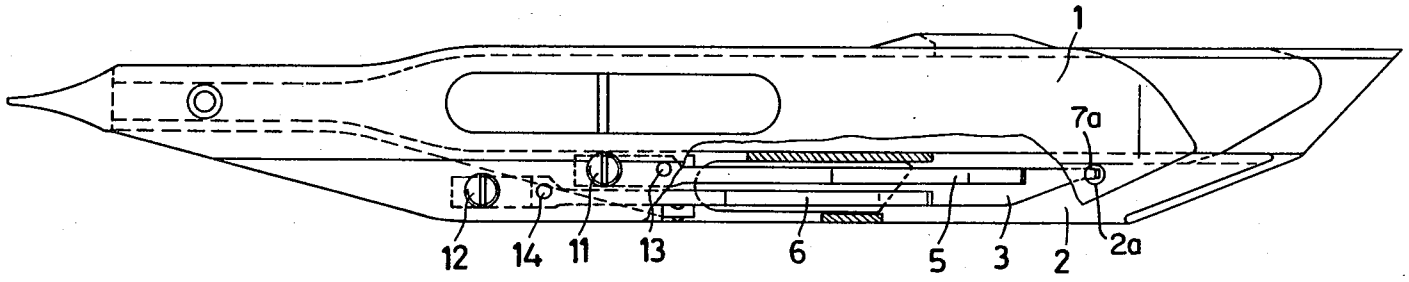
FIG. 2 is a front view of the pincer of FIG. 1, taken from the weaver's position, with parts cut away.
Figure 3:
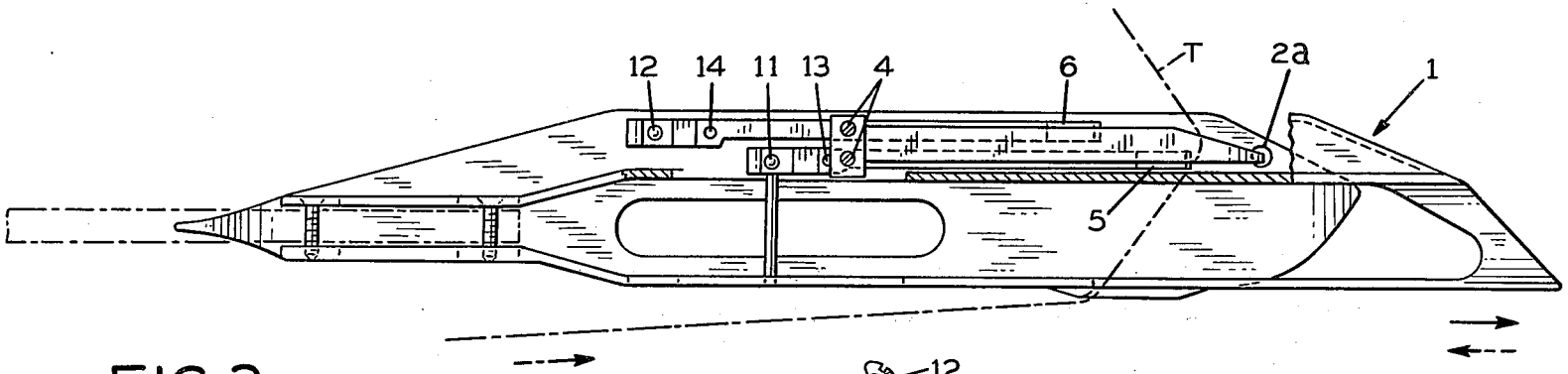
FIG. 3 is a side view, similar to FIG. 2, but showing the leading pincer in the inverted position.
Figure 4:
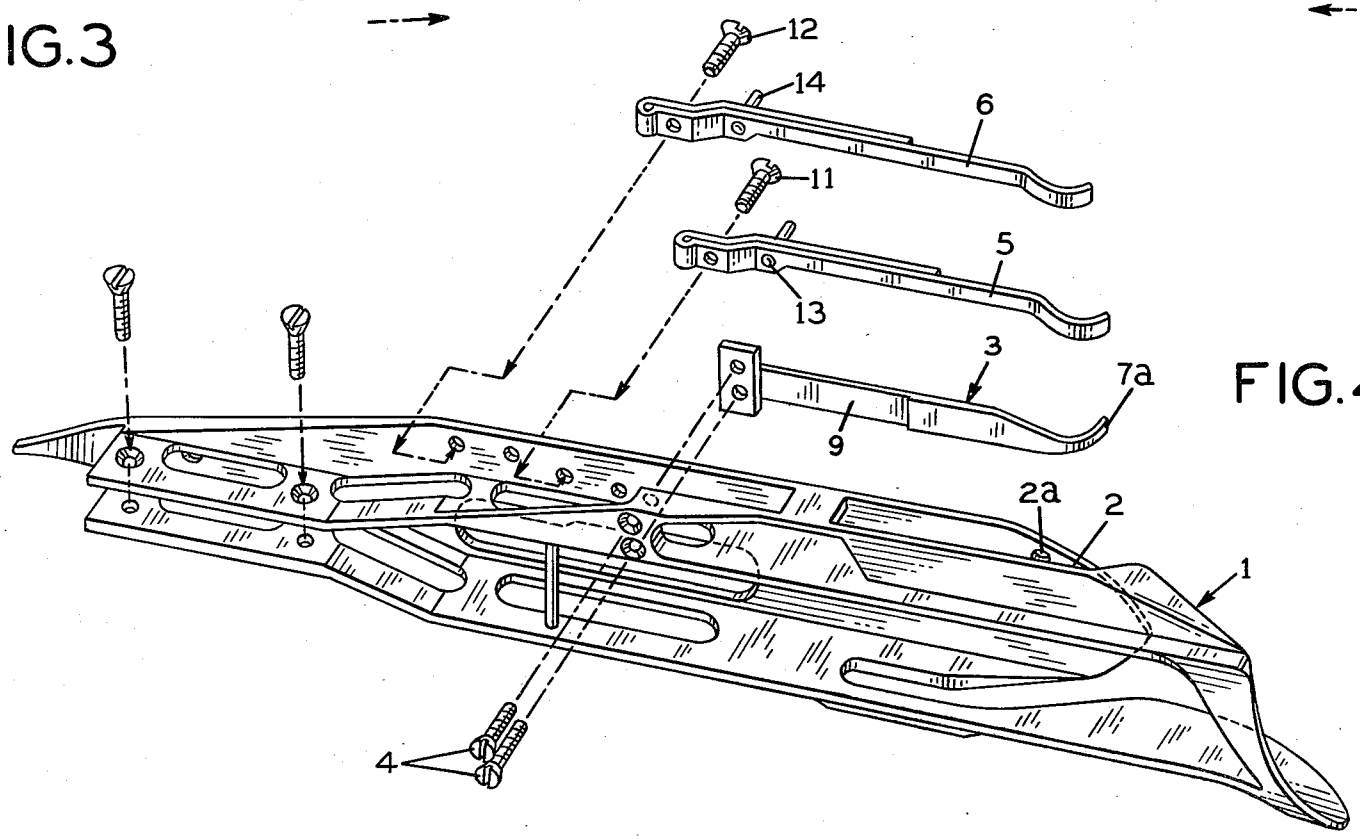
FIG. 4 is an exploded perspective view of the leading pincer of FIG. 3.
Figure 5:
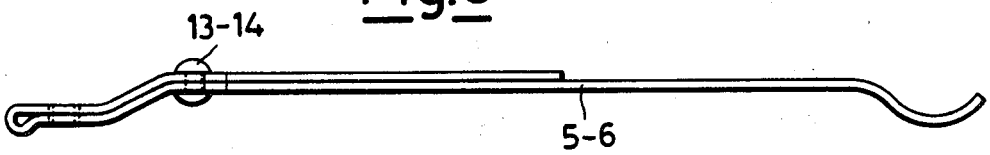
FIG. 5 is a top view of the leading pincer leaf spring.
Figure 6:
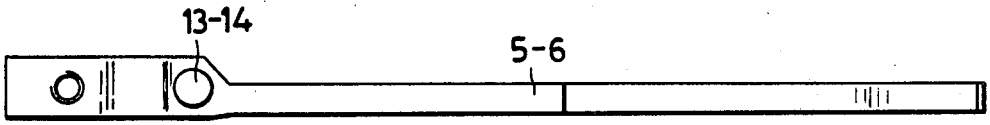
FIG. 6 is a side view of the leaf spring of FIG. 5.

The wedge-like aperture at front input position 7 of blade 3 is by long portion 8 of blade 3 which, with grasping plane 2 of body 1, forms a grasping aperture with a minimum grasping angle. This permits smooth grasp, even if at a high speed (40 meters a second), of weak, thin threads and is accomplished through springs 5 and 6, shown in enlarged scale in FIGS. 5 and 6, having a high specific resiliency (sag/load) and capable of bearing high loads. At their free or forward ends, leaf springs 5 and 6 engage the surface of blade 3 and resiliently bias planar portion 8 of blade 3 into engagement with rigid plane 2 of body 1. By adjusting the setting of screws 11 and 12 (FIGS. 1–4) the leaf spring concerned is biased about pivot 13 or 14, as the case may be, and is loaded. Spring 5 acts upon the internal edge of clamping blade 3 and immediately close to input curvature 7 of the blade. Spring 6 acts on the external edge of blade 3 and on the rear portion of the planar grasping and clamping portion 8 thereof. The kind, the arrangement and independence of adjustment of the springs 5 and 6 and the shape and the thickness of the planar portion 8 of clamping blade 3 act in such a way that, in the longitudinal direction, the distribution of the specific clamping load between the blade 3 and the rigid plane 2 can be varied over a wide range.

In addition to the maximum and minimum values of the specific loads, the load diagram itself can be varied, for example by varying the load of either spring 5 or spring 6. By loading, for example, only the rear spring 6, blade 3 becomes rigid and the diagram becomes triangular with the maximum value on the rear, the maximum being at any value within the range of load of spring 6. As a function of the flexibility in the grasping portion 9 (FIGS. 7–8) the diagram, instead of being triangular, that is of first degree, becomes one of a higher degree. The entrance of the thread can, in any event, be smooth and permits the insertion and grasp at a high speed ("flying" grasp). The importance of the variability of the shape of the loading diagram in question is illustrated by the following considerations:

1. Insertion of a group of any wefts, different as to the count and the heterogeneousness of the threads. It is known that, it is the more difficult to cut a thread the greater the weight and number of twists per unit of length, the larger and more sturdy the fibre, and others. It is also generally true that the longer to complete the cutting step, the higher the tensile strength of the yarn. Proportionally higher must also be the braking required for controlling the mass forces of the weft which is subjected to abrupt decelerations. The insertion of the weft t in the grasping aperture under the blade 3 is caused by the longitudinal component of the drags T1 and T2 (FIG. 13) at the two ends of the presented weft. T1 is a function of the braking. The longitudinal component of T2 is twice a function of the cut delay, because the drag T2 on the end coming from the selvedge C can be increased up to the instant of time of cutting whereas the angle between the wefts and the blade is decreased (D is a fixed point and the pincer is being advanced). With a load diagram, for example, trapezoidal, the sturdier wefts are inserted on the rear at the bottom of the grasping aperture whereas the weaker and thinner wefts are inserted at the start of the grasping aperture because they are cut before and are less intensively braked. The suitable adjustment of the loading diagram of the weft-grasping blade 3 by adjustments of springs 5 and 6 permits that each thread is pinced with a force which is proportional to its tensile strength by inserting the thread more or less deeply into the grasping aperture. The result is that the pincer operates on each thread in the most adequate manner to its sturdiness and permits the transfer of any succession of wefts irrespective of the count and the different nature of the wefts.

2. By increasing the resistance and braking differentials of the threads of a group, the suitable diagram will tend to become converted into a triangular plot. Conversely, with a group of homogeneous wefts, which possibly are very thin and weak, the most suitable diagram is almost rectangular, of course with very low values also for the maximum clamping force on the rear. The wedge-like shape of the inlet aperture and the possibility of imparting to the loading diagram of the blade against the rigid grasping plane a trapezoidal shape, or a triangular one (by unloading front spring 5) the necessity is eliminated of braking the weft to the end of inserting it into the grasping aperture of the leading pincer once the braking force is reduced. Also the clamping of the grasping aperture of the leading pincer, which is necessary for transporting the weft to the center line of the warp, is decreased.

Figure 13:
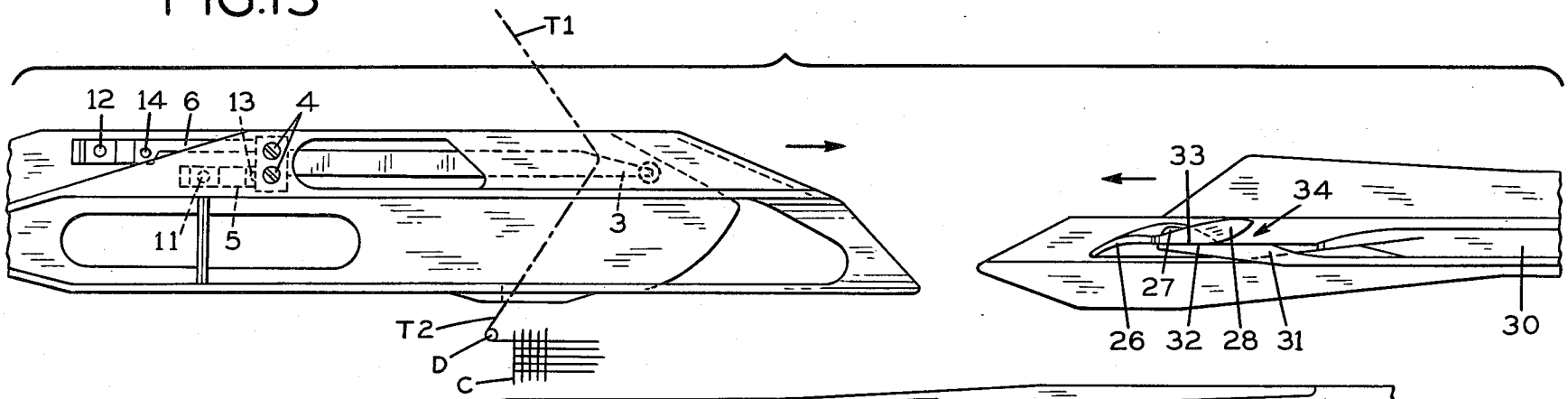
FIG. 13 is a side view of the forward pincer ends as shown in FIG. 12.
Figure 14:
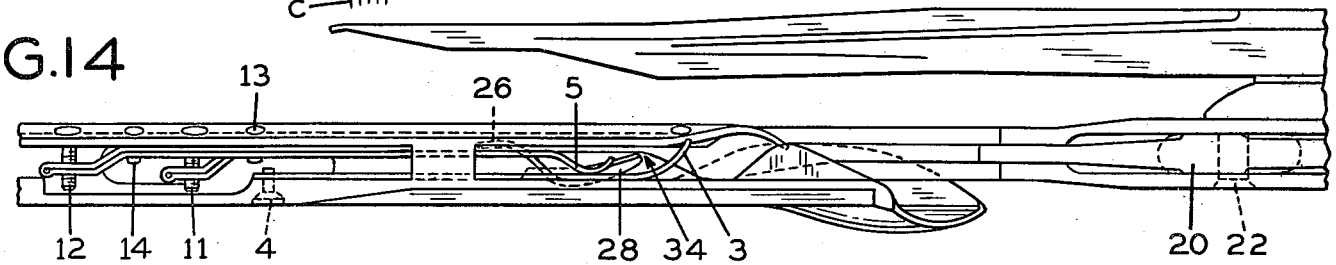
FIG. 14 is a top view showing the forward pincer ends as in FIG. 12 but with the ends engaged for weft yarn transfer.
Figure 15:
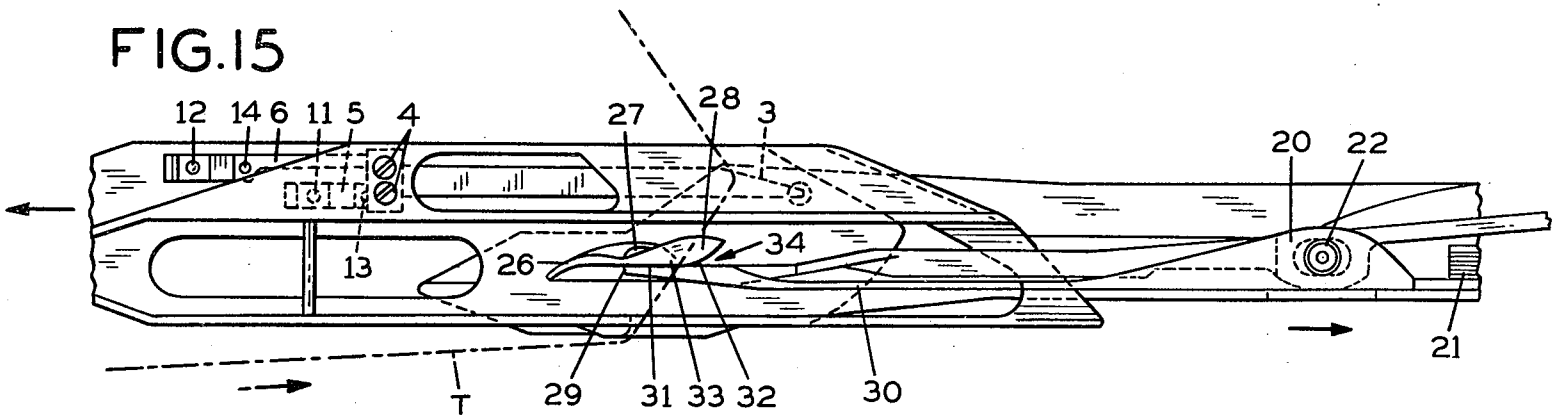
FIG. 15 is a side view of the engaged pincer ends of FIG. 14.
Figure 16:
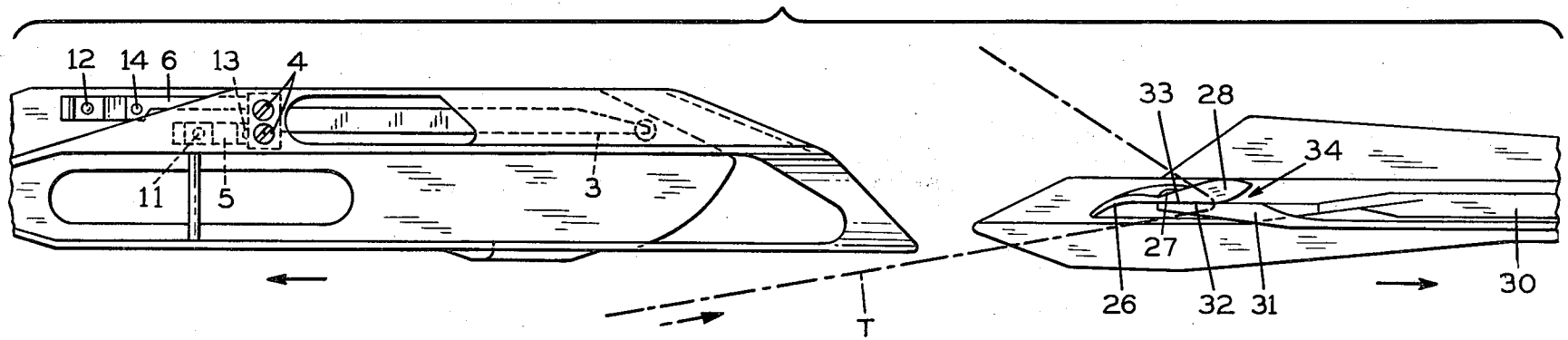
FIG. 16 is a side view similar to FIG. 13 but showing the weft yarn after transfer and the pincers moving apart.
Figure 17:
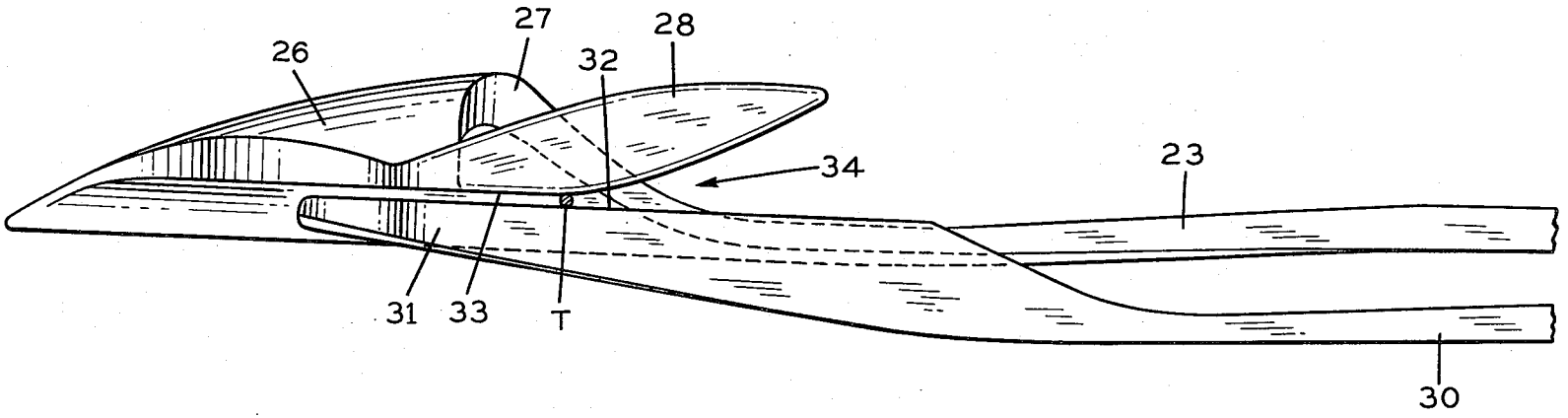
FIG. 17 is an enlarged view of the drawing pincer branches showing, in enlarged detail, the cooperating yarn grasping surfaces.

The drawing pincer (FIGS. 9–11) comprises a fixed branch 30, which is mounted on pincer-carrier member 40, branch 30 carrying the spring 21 and a pin 22 on which the movable branch 23 is linked so as to permit the disengagement of the weft at the end of the transfer stroke. The bias of the spring 21 causes the pad 24 of the movable branch 23 to rest against the specially provided abutment surface 25 of the fixed branch 30. The bias of spring 21 is such as to achieve the blocking of the movable branch irrespective of the magnitude of the mass forces which are originated during motion, more particularly also at more than 300 insertions a minute. The front portion of the movable branch carries the grasping hook 26, which, according to a conventional scheme, has the thread positioning notch 27 (FIG. 11) and two beveled edges, one, 28, adjacent to the notch, and the other, 29, adjacent to the grasping plane. The front portion of the fixed branch is formed by a short and thin resilient blade 30 terminated by the narrow and slight widening 31, the latter carrying the machined lower grasping surface 32. When the pincer is closed, the surface 32 (FIG. 11) is inclined downwards relative to the horizontal and slightly pushed towards the horizontal grasping surface 33 (FIG. 11) of the movable upper branch of the resilient blade 30 of which it is an integral part. Such a slight force, however, is many times a multiple of the mass forces induced by the vibrations in the resilient blade and in the end widening, due to their overall light weight. At the weft shift, under the effect of the braking on one thread end, and of the drawing drag from beneath the weft-clamping blade of the leading pincer on the other thread end, the weft is inserted into the drawing pincer and causes the lowering and depression of the lower grasping plane 32. Once the weft t has been inserted, it is wrapped around the two edges of the hook which increase the hold, and one end remains slightly clamped between the grasping surfaces 32, 33 (FIG. 13). Wefts having a considerable diameter (4 millimeters) are inserted as easily as the weft having an average diameter of the thin wefts, due to the high specific resiliency (sag/load) and the slightest clamping which is required now for holding and transferring the weft because the effects of vibrations are overcome. If the weft cannot be inserted because of low tensile strength and weft diameter, the weft is grasped and held without depressing the lower grasping surface, that is, without opening the grasping aperture. The wedge-shaped grasping aperture 34, (FIG. 16) grasps and holds the weft subjected to the transfer drag as soon as the weft is presented. The drag of the end held by the leading pincer can be nil and on the braked end coming from the spool the drag can be from zero and to the tensile strength of the weft. The greater the resistance to drag of the shifted thread, the deeper the thread is inserted into the aperture 34 (FIG. 16) and the greater it is grasped. The shape of the aperture is such that the grasping force is automatically at least twice the dragging force. This has the effect of inserting the thread irrespective of the nature of the fiber and the kind of yarn.

As the drag is increased, as the robustness of the thread is increased, the grasping takes place as described at the beginning of this disclosure and the presence of the grasp-multiplying edges permits a reliable transfer with a pinching force at the cut end at a minimum.

The wedge-like shape of the grasping aperture 34 of the drawing pincer and the slight clamping of one surface against the other, sufficient for a reliable hold, permit the exchange of the weft and the insertion into the pincer without requiring a drag on the thread end held by the leading pincer where it is clamped only sufficient to ensure the transfer of the weft. The clamping force is at a minimum since the braking is at a minimum and serves only to control the mass forces which are proper of the weft. The deposit of fibers and other impurities in the grasping apertures and in the brakes is minimized. Stopping of the textile machine to clean the apertures and brakes is substantially reduced.

In the leading pincer, which is proner to fiber deposits, the drastic reduction of the clamping loads, in general and especially at the inlet (a loading diagram which is trapezoidal or triangular) permits the sturdier weft to reach more easily and reliably the bottom of the grasping aperture, thus carrying out a cleaning action and dispelling the impurities or fiber deposits through the specially provided window arranged at the bottom of the grasping aperture itself.

The grasping members of the leading and the drawing pincers are so proportioned and stressed so as to make possible the transfer of light, as well as heavy, weft threads and combination of such threads, either alone or woven together with other wefts having any count, to reduce the braking and the clamping of the grasping members necessary to effect such transfer and to limit the deposition of fibers and impurities under the grasping and braking members and the consequential stoppages occasioned thereby.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed:

1. A pair of pincers for looms having a stationary weft reserve and shift of the wefts in the middle of the warp shed in which the leading pincer of said pair of pincers is formed by a boxlike member shaped in the front portion for receiving high speed input of the weft arranged diagonally of said pincer and for smooth and bumpless sliding of the warp threads and having milled on a side wall, a narrow longitudinal slot the lower plane of which is a rigid plane for grasping the weft and on which rests one weft-clamping blade of semi-rigid structure and curved upwardly away from said rigid plane at the forward end of said blade and affixed at the rear end of said blade to the pincer body and pressed at its top and adjacent its two side edges by a spaced pair of leaf springs each spring of said pair of springs being independent of the other spring of said pair and being independently loaded, the first of said springs applying a pressing force to one side edge of said blade adjacent the curved forward end of said blade, the other of said springs applying a pressing force to the other side edge of said blade and spaced along said blade rearwardly to the point where the force of said first spring is applied to said blade so that the longitudinal load diagram between the blade and the grasping plane applied by said pair of leaf springs is adjusted by said independent loading of said leaf springs, the drawing pincer of said pair of pincers including a lower fixed branch and a hook-carrying movable branch pivotal mounted on said drawing pincer and urged by a sturdy spring into pivotal engagement at one of its ends with a specially provided abutment of the fixed branch for locking engagement therewith during grasping and transfer of the weft, the fixed branch having at the front portion of said abutment a short and lightweight resilient portion terminated by a narrow and lightweight widening portion having a lower grasping surface urged towards the corresponding grasping surface of the hook by a resilient blade of which it is a part and which is depressed by insertion of the weft.

2. A pair of pincers, according to claim 1, in which said upwardly curved forward end of said weft-clamping blade and said rigid weft grasping plane of said leading pincer and said grasping surfaces of said fixed branch and said hook-carrying movable branch of said drawing pincer are wedge-shaped with an angle of aperture narrower than the angle of friction between the weft and the metal so as to grasp and hold the weft as soon as it is presented.

3. A pair of pincers, according to claim 2, in which said weft-grasping blade of the leading pincer has a resiliency which is proportional to the maximum load of the spring and has, successively, a curved front inlet portion forming a long wedge-shaped grasping aperture, a planar semi-rigid portion resting on the rigid grasping surface of said right plane, a long portion having a considerably reduced thickness and high flexibility and an end portion having the original thickness and fastened by screws to the pincer body, each of said leaf springs having a high flexibility and having a pivot and a screw for independently loading said spring.

* * * * *